US005621933A

United States Patent [19]

Knapp et al.

[11] Patent Number: 5,621,933

[45] Date of Patent: Apr. 22, 1997

[54] LIFT COLUMN FOR A SURGICAL SUPPORT

[76] Inventors: Jürgen Knapp, Heinrich-Heine-Strasse 10, D-93138 Lappersdorf; Robert Geiger, Berg, Mettener Strasse 24, D-94526 Metten, both of Germany

[21] Appl. No.: 351,627

[22] Filed: Dec. 8, 1994

[30] Foreign Application Priority Data

Dec. 8, 1993 [DE] Germany ..... 43 41 779.5

[51] Int. Cl.[6] ..... A61G 13/00

[52] U.S. Cl. ..... 5/608; 5/610; 5/611; 5/607

[58] Field of Search ..... 5/11, 607, 608, 5/610, 611

[56] References Cited

U.S. PATENT DOCUMENTS

| | | | |
|---|---|---|---|
| 3,808,103 | 4/1974 | Pageot | 5/608 |
| 4,558,857 | 12/1985 | Heller | 5/608 X |
| 4,572,493 | 2/1986 | Hubert . | |
| 4,589,642 | 5/1986 | Schnelle et al. | 5/610 X |
| 4,958,817 | 9/1990 | Heller | 5/608 X |
| 5,398,356 | 3/1995 | Pfleger | 5/608 |

FOREIGN PATENT DOCUMENTS

| | | |
|---|---|---|
| 2301288 | 10/1973 | Germany . |
| 2260140 | 6/1974 | Germany . |
| 2612800 | 10/1976 | Germany . |
| 3621480 | 1/1988 | Germany . |
| 9313149 | 12/1993 | Germany . |

OTHER PUBLICATIONS

WO86/01099—PCT Patent Application–Brady Feb. 27, 1986.

*Primary Examiner*—Michael F. Trettel
*Attorney, Agent, or Firm*—Lucas & Just

[57] ABSTRACT

A lift column suitable for use in a patient rest or operating table, or for industrial applications, is disclosed. The lift column is a simple compact structure without service members or other elements extending laterally beyond the confines of the lift column. The maximum travel of the lift column is greater than the structural height of the column. Furthermore, the patient rest or operating table can be swung about two horizontal axes which are perpendicular to each other.

31 Claims, 9 Drawing Sheets

LIFT COLUMN FOR A SURGICAL SUPPORT

FIELD OF THE INVENTION

The invention relates to a lift column according to the generic clause of claim 1 and to a patient rest according to the generic clause of claim 23.

DESCRIPTION OF THE RELATED ART

A lift column of this generic kind, and a patient or operating table comprising such a lift column, are known (German Letters of Disclosure DE-OS 2,260,140). In the known case, an upper member for a vertical travel, or a vertical reciprocating motion, is guided at the base of the lift column, which motion is effected by a first servo element acting upon the upper member and on a lower member of the base. At the upper member, by way of an articulation, the swing beam is fixed, swingable in two horizontal axes extending perpendicular to each other. By means of a second and a third servo element, each acting between the swing beam and the lower member, the swing beam can be stabilized in every location of the vertical travel, and so can a tipping or tilting motion of the swing beam about the two axes of swing. The servo elements are preferably lift cylinders. One disadvantage here, is that the maximum travel of the lift column is determined by the stroke of one of the servo elements, i.e. by the structural height of the lift column.

An operating table of similar configuration is likewise known (U.S. Pat No. 4,572,493) in which the upper member is displaceably guided by a sleeve-like part on a cylindrical column of the lower base. Here again, the maximum travel is determined by the structural height of the lift column.

Lastly, there is a known patient or hospital bed (German Utility Design DE GM 9,313,149) in which, for vertical adjustment, between a bottom frame and a top frame, in addition to telescoping guide elements, a lift means composed of a telescoping threaded spindle and an associated motor is provided.

SUMMARY OF THE INVENTION

The object of the invention is to disclose a lift column distinguished by an especially simple, compact and stable structure and having a vertical travel greater than the structural height of the lift column.

The advantages of the invention consist, among other things, in a simple compact structure, and one avoiding servo members or elements extending laterally beyond the confines of the lift column, and capable of being built using commercially available parts to a very large extent.

An especial advantage of the invention consists in that the maximum travel is greater than the structural height of the lift column.

Additional advantages of the lift column according to the invention are:

- Achievement of a vertical travel and a tip and tilt motion by implementation of four cylinders, affording a high stability and strength of the lift column;
- A simple structure, and one achievable in particular with use of standardized components;
- Long travel with low structural height;
- Compact structure with small diameter of the lift column;
- High stability and strength;

- Low flow volume of hydraulic fluid, likewise making possible a small and compact structure for the hydraulic system;
- Wide range of swing and adjustment for the rest or hearing surface on which the patient is to lie.

With appropriate configuration, moreover, a low flow volume and hence low consumption of current by the pump motor can be achieved, making possible a small, energy-saving hydraulic system, capable in particular of operating on a battery.

The lift column according to the invention is suitable especially for application to patient rests or treatment platforms, but also for industrial applications where raisable and lowerable carrier members, pallets or platforms are required, having a tip and tilt motion in addition to a vertical travel. A patient rest or treatment platform according to the invention is configured in accordance with the characterizing part of claim 18.

Refinements of the invention are the subject of the subsidiary claims.

BRIEF DESCRIPTION OF THE DRAWING

In the following, the invention will be illustrated in more detail in terms of embodiments with reference to the figures By way of example. In the drawing, FIG. 1, in simplified, schematic representation, partly in side view (references a–d) and partly in front view (references e+f), shows a medical table according to the invention, with the pallet in various positions.

DESCRIPTION OF THE PREFERRED EMBODIMENTS

The patient rest or operating table shown in the figures consists essentially of a pallet or patient lying surface 1, a base 2, and a support and lift column 3 between the base 2 and the lying surface 1.

The lift column 3, its top end fixed on the under side of the lying surface in the center thereof and its bottom end held in the center of the base 2, serves as a load assuming and carrying member and also for an adjustment of the lying surface 1 relative to the base 2 and fixation of the adjustment from time to time of the lying surface 1.

Figure 1A:
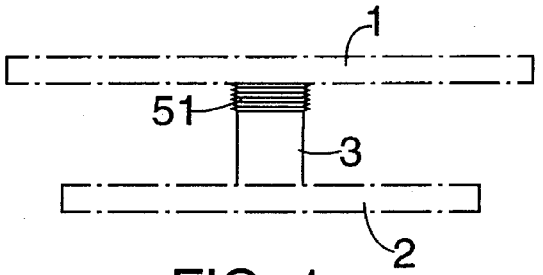
Figure 1B:
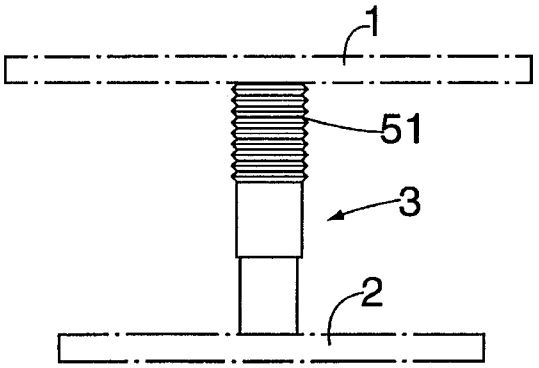
Figure 1C:
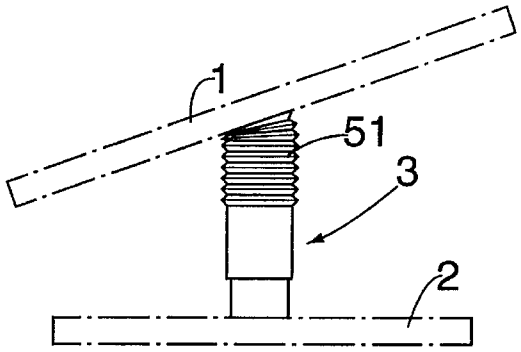
Figure 1D:
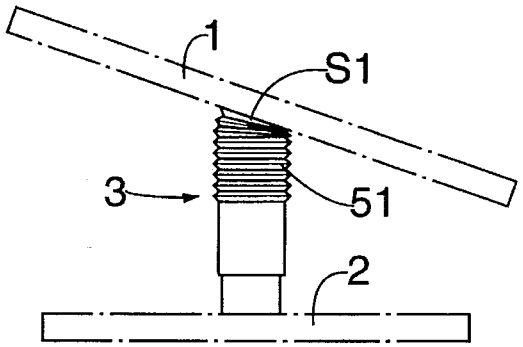
Figure 1E:
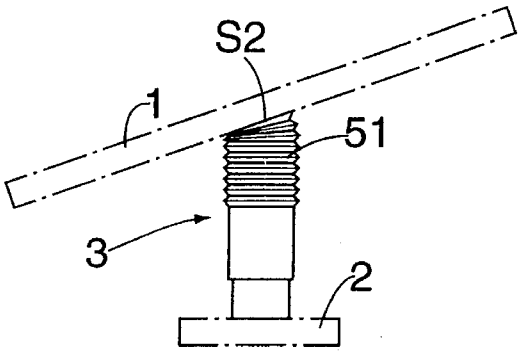
Figure 1F:
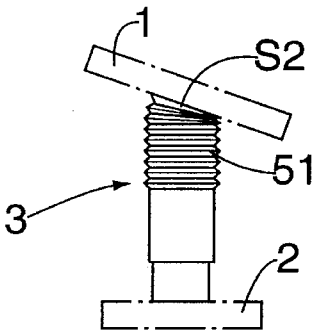
Figure 2:
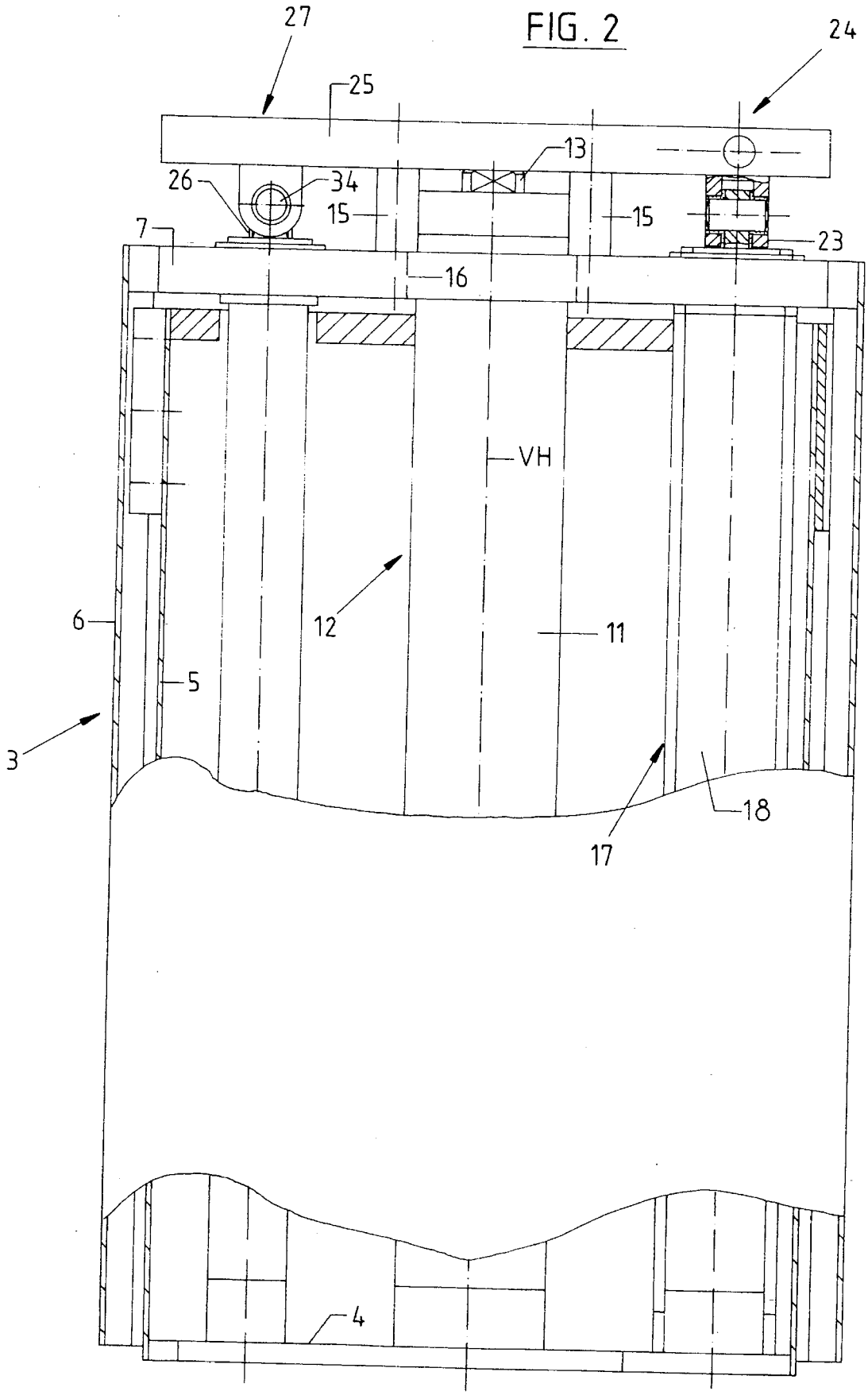
FIG. 2, in simplified representation and longitudinal section, shows the lift column of the table according to FIG. 1.
Figure 3:
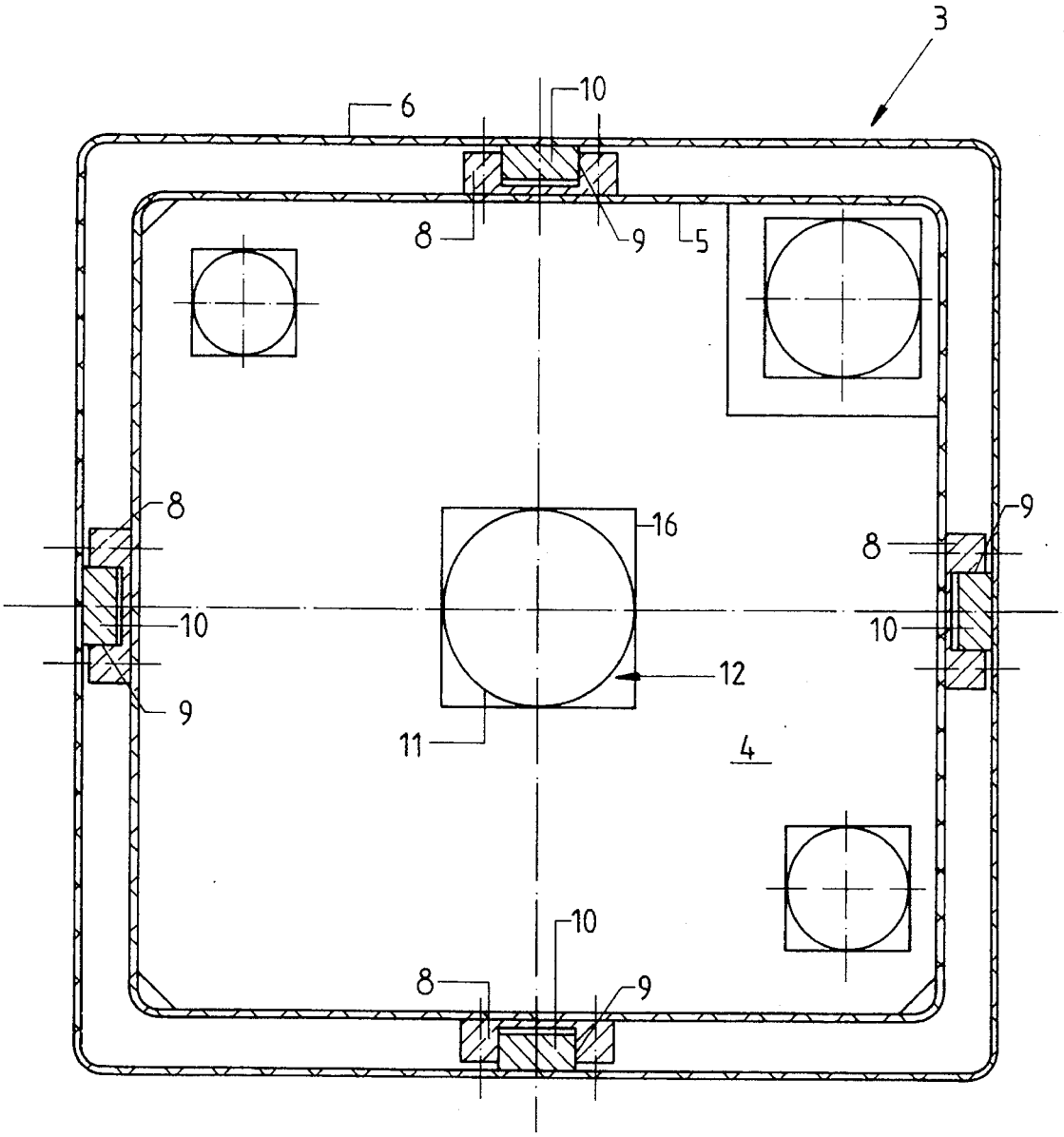
FIG. 3 shows a section at the line I—I in FIG. 2.

The adjustment comprises firstly a height adjustment in a vertical axis VH, namely between a bottom lift setting in which the distance between the under side of the lying surface 1 and the top of the base 2 is for example 400 mm and a top lift setting in which said distance is for example 1000 min. Besides, the lift column 3 is capable of swinging the patient lying surface 1 about two horizontal axes extended perpendicular to each other, namely about an axis S1 perpendicular to the lengthwise centerline of the rectangular lying surface 1 (FIG. 1*c, d*) and about an axis S2 parallel to the centerline of the lying surface 1 (FIG. 1*e, f*).

All setting motions can be executed each singly, or else combined with each other in any way.

In order to achieve these setting motions with small and compact configuration, high rigidity and especially small diameter of the lift column 3, the latter is configured in the manner represented in FIGS. 2 to 6.

Accordingly, the lift column 3 consists essentially of a bottom support plate 4 fixed at a horizontal plane, i.e. in a plane perpendicular to the axis-of the lift motion, to the base 2 and having a square figure in the embodiment shown. The support plate 4 is fixed to the bottom end of a tubular inner housing part 5, i.e. the support plate 4 here closes the housing part 5 off downward, the latter having a square cross section matching that of the support plate 4 and an axis coinciding with the axis VH.

The inner housing part 5 is enclosed telescope-fashion by an outer, likewise tubular, housing part 6 having a square inside and outside cross section, but an inside cross section somewhat larger than the outer cross section of the housing part 5. At the top end of the housing part 6, whose axis again coincides with the axis VH, a top support plate 7 is fixed, which in turn has a square cross section and is enclosed by and connected to said housing part at its periphery.

In the region of the upper, open end of the housing part 5, in the center of each side of the periphery of said housing part, a guide piece 8 is fixed, located on the outside. Each guide piece 8, in the embodiment shown, has a U-shaped cross section open to the outside in a cross-sectional plane perpendicular to the axis VH, which cross section forms a guide groove 9 parallel to the axis VH in its lengthwise extent and open at both ends, which groove is engaged by bearing slide 10 in the form of a rail. Each slide 10 is fixed on the inner surface of a peripheral side of the housing part 6 and extends, in its lengthwise extent likewise paralleling the axis VH, over the entire height of the housing part 6.

To the bottom support plate 4 is fixed the cylinder housing 11 of a lift cylinder 12 whose piston rod 13 acts on the top support plate 7. The lift cylinder 12 lies coaxial with the axis VH. To achieve a low structure of the lift column 3 with greatest possible length of the hydraulic lift cylinder 12, and hence greatest possible vertical travel, the piston rod 13 does not act on the top support plate 7 directly, but on an auxiliary plate 14, held to the support plate 7 at a distance above it with the aid of spacers 15. The support plate 7 for this purpose has an opening 16 through which the lift cylinder 12, or the cylinder housing 11 in the setting at the bottom of the travel, i.e. with support plate 7 lowered all the way, projects beyond the top of said support plate.

With the aid of the lift cylinder 12, the support plate 7, and with it the housing part 6, are movable to and fro in vertical direction, while the tubular configuration of housing parts 5 and 6 and the guidance of these housing parts on each other with the aid of the guide pieces 8 and bearing slides 10 results in a fixed and torsionally rigid connection between housing parts 5 and 6 and hence between support plates 4 and 7 as well.

On the support plate 7, viz. in the regions of three corners of said support plate, three lift cylinders are fastened, their centerlines each located parallel to each other and parallel to the axis VH, namely in the region of one corner the lift cylinder 17 with cylinder housing 18 and lift cylinder 19 with cylinder housing 20, and lift cylinder 21 with cylinder housing 22 respectively. This arrangement is made in such a way that a lift cylinder 19, 21 is located on either side of the lift cylinder 17 in each neighboring corner.

The lift cylinders. 17, 19 and 21 are each rigidly connected to the top support plate 7 and each have a like zero length of travel, to wit in such manner that the lower ends, away from the support plate 7, of the lift cylinders 18, 20 and 22, are located immediately adjacent to the top of the lower support plate 4, i.e. exhibit only a small clearance at the top of said support plate, when the lift cylinder 12 is lowered or retracted.

The piston rod 23 of the cylinder 17 is connected by way of an articulation 24 to a swing plate 25 arranged above the support plate 7, namely in the region of a corner of the swing plate 25, likewise having a square figure.

The piston rod 26 of the lift cylinder 19 is fastened by way of an articulation 27, and the piston rod 28 of the lift cylinder 21 by way of an articulation 29, to the swing plate 25, namely again in the region of a corner of said swing plate whereon the patient lying surface 1 is attached. The articulation 24 is a double articulation, exclusively permitting a swing of the swing plate 25 about two axes S1' and S2', lying parallel to the axes of swing S1 and S2 at least when the swing plate 25 is horizontal. For this purpose, the articulation 24 comprises two pivots 30 and 31. The articulations 27 and 29 are likewise configured as double articulations, i.e. in such manner that a swing of the plate 25 relative to the piston rod 26 or 28 in question is possible about the two axes of swing S1 and S2; at the same time, each articulation 27, 29 is also configured as a slide bearing, i.e. each articulation 27, 29 permits a motion of displacement in an axial direction S2', S1' lying in a common vertical plane with the axis of swing S2, S1, respectively, and also in the plane of the swing plate 25. These axes S1' and S2' are each so oriented that for each articulation 27, 29 a sliding motion is possible in the direction of an augmentation and a diminution of the distance from the articulation 24.

Accordingly, each articulation 27 consists of a slide 32 displaceably guided on a slide pin arranged with its axis in the axis S1', S2' in question and held on the swing plate 25, and which slide is articulately connected by way of a pivot 34 to the end of the piston rod 26, 28 in question, the pivot 34 being oriented in horizontal direction with its axis perpendicular to the axis S1' or S2' in question.

In the middle region, the swing plate 25 has an opening 35 which, when the swing plate 25 is lowered onto the support plate 7, i.e. when the lift cylinders 17, 19 and 21 are retracted completely, accommodates the auxiliary plate 14.

The lift cylinders 12, 17, 19 and 21 are each double-action hydraulic cylinders.

Figure 7:
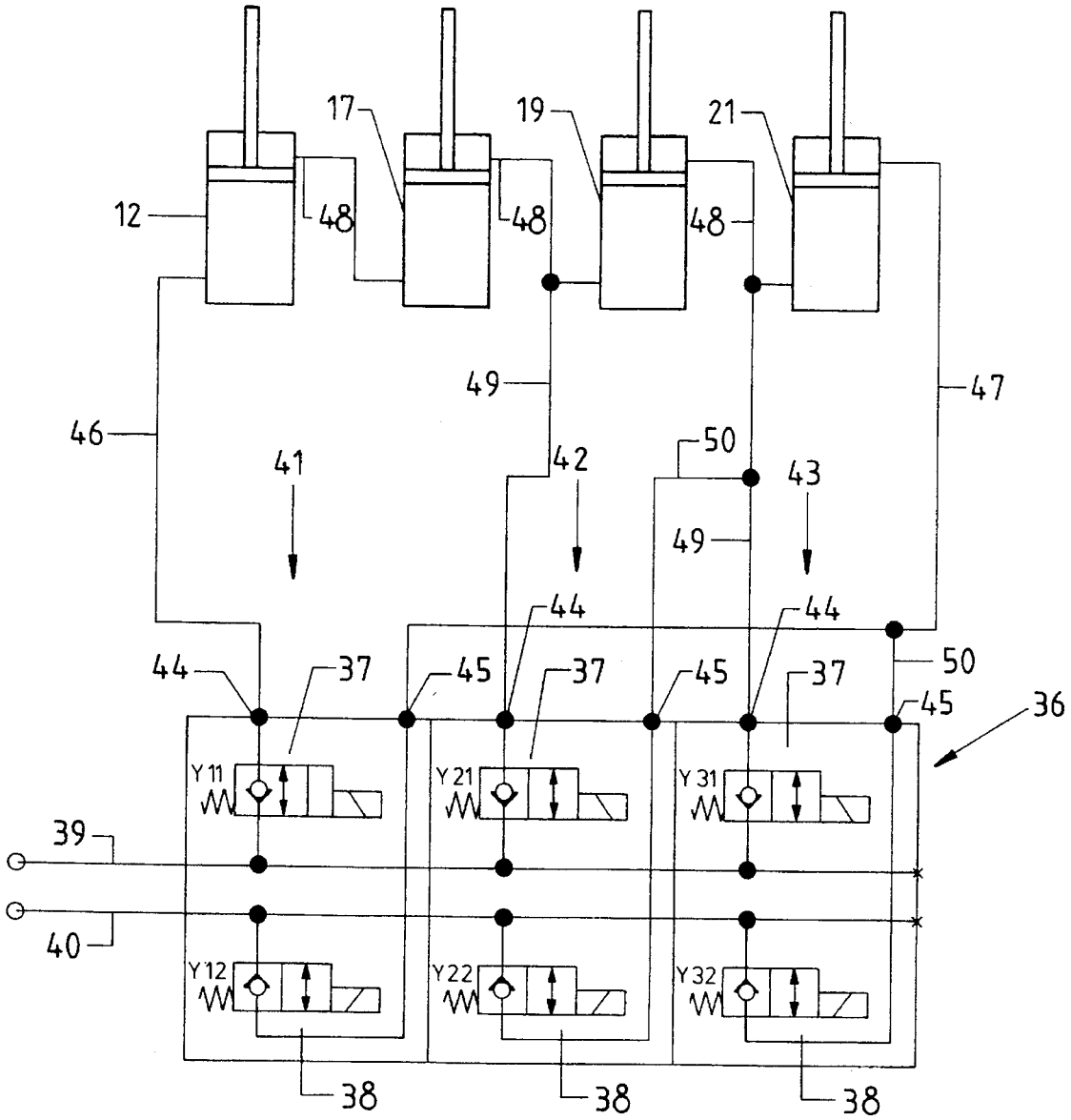
FIG. 7, in simplified representation, shows the hydraulic circuit diagram for the total of four hydraulic cylinders.

FIG. 7 shows the actuation of the lift cylinders 12, 17, 19 and 21. They are actuated by a control means 36 comprising a total of three pairs of electro-magnetically controllable 2/2-way seat valves 37 and 38, whose closed position is in each instance the rest position, and which are open in activated condition. These 2/2-way seat valves 37 and 38 further have the properties that in their closed position, they act as check valves, i.e. in that position they cut off a flow of hydraulic fluid (oil) from 'entrance' to 'exit,' whereas (likewise with valve closed) a flow of hydraulic fluid in reverse direction, i.e. from exit to entrance, is possible.

By their 'exits,' the valves 37 and 38 are connected to lines or passages 39 and 40, namely valves 37 each to line 39 and valves 38 each to line 40. Both lines lead to a hydraulic system, not shown, controllable between at least two states, namely in such manner that in the one state the line 39 is the pressure line and the line 40 is the line leading to the tank, and in the other state the line 40 is the pressure line and the line 39 is the line leading to the tank.

In each instance one control valve 37 and one control valve 38 form a control division 41, 42 or 43 together with an output 44 and 45 in each instance, each output 44 being formed by the entrance of a control valve 37 and each output 45 by the entrance of a control valve 38 of the control division 41–43 in question.

The lift cylinders 12, 17, 19 and 21 are connected by way of hydraulic lines 46 and 47 and by way of intermediate lines 48 to the outputs 44 and 45 of the control division 41, namely in such manner that the chambers of the lift cylinders 12, 17, 19 and 21 are in series, and this specifically in such manner that the following connections result:

From cylinder chamber formed by full piston area of lift cylinder 12 by way of line 46 to output 44, From cylinder chamber formed by annular piston area of cylinder 12 by way of intermediate line 48 to cylinder chamber formed by full piston area of lift cylinder 17, From chamber of cylinder 17 formed by annular piston area by way of intermediate line 48 to chamber of cylinder 19 formed by full piston area, From chamber formed by annular piston area of lift cylinder 19 by way of intermediate line 48 to chamber of lift cylinder 21 formed by full piston area, From chamber of lift cylinder 21 formed by annular piston area By way of line 47 to output 45 of control division 41.

At the outputs 44 and 45 of control divisions 42 and 43, additional hydraulic lines 49 and 50 are fitted, namely at outputs 44 the hydraulic line 49, of which the line 49 connected to the output 44 of control division 42 is connected to the connecting line 48 between lift cylinders 17 and 19, and the line 49 at the output 44 of control division 43 is connected to the connecting line 48 between lift cylinders 19 and 21. The line 50, at the output 45 of control division 42 is connected to the connecting line 48 through lift cylinders 19 and 21, and the line 50 of output 45 of control region 43 to line 47.

The several piston areas of the lift cylinders 12 are moreover so proportioned to each other that the cylinder chambers connected to each other by an intermediate line 48 in each instance exhibit a piston surface of like area, so that the following situations prevail:

Annular piston area of lift cylinder 12=full piston area of lift cylinder 17

Annular piston area 17=full piston area of lift cylinder 19

Annular piston area of lift cylinder 19=full piston area of lift cylinder 21

Considering the aforesaid proportioning of the piston areas, the control means is capable of a synchronous reciprocating motion of the piston rods of all lift cylinders 12, 17, 19 and 21 by a like amount in each instance, namely an upward motion by subjecting line 39 to the hydraulic pressure and leaving line 40 pressureless, i.e. connected to the tank. For the upward motion, only the control valve 38 of control division 41 is opened, so that the hydraulic fluid can drain out of the upper chamber of lift cylinder 21 by way of the control valve 38, while the closed valve 37 of control division 41, acting by way of the check valve, . . . hydraulic fluid passes out of the pressure line 39 into the lower chamber of the lift cylinder 12. Besides, the two lift cylinders 19 and 21 are controllable for an upward motion individually as well, namely again in that for this purpose also, the control valve 38, connected to the pressureless line 40, of control division 42 (for an individual upward motion of lift cylinder 19) or the control valve 38 of control division 43 (for an individual upward motion of lift cylinder 21) is opened.

Similarly, a synchronous downward motion of all lift cylinders 12, 17, 19 and 21 as well as an individually controlled downward motion of lift cylinders 19 and 21 is possible, namely in that by appropriate switching of the hydraulic system the line 40 becomes the pressure line and line 39 the pressureless line, and for a synchronous motion of all lift cylinders, the control valve 37, connected to the pressureless line 39, of control division 41 is opened, and for the individual downward motions of lift cylinders 19, 21 the control valve 37 of control division 42 (for the individual downward motion of lift cylinder 19) is opened, or the control valve 37 of control division 43 (for the individual downward motion of lift cylinder 21) is opened.

With the control described, it is possible by synchronous motion of all lift cylinders to move the patient lying surface 1 up and down, the maximum travel thus obtainable being equal to the maximum travel of the lift cylinder 12 plus the maximum travel of one of the lift cylinders 17, 19 and 21. Through the individual control of the lift cylinders 19 and 21, a swinging of the swing plate 25 and hence of the patient lying surface 1 about the axes of swing S1 and S2 is possible as well, namely by swinging the swing plate 25 about the axes of the articulation 24.

By the housing parts 5 and 6 nested telescope-fashion, the lift column is closed from the outside in the region of these housing parts. Between the swing plate 25 and the upper support plate 7, a flexible, bellows-like covering element 51 is provided. The hydraulic system as well as the control means 36, or the control valves 37 and 38 constituting the said control means, are accommodated in the interior of the lift column 3, i.e. in the space enclosed by the housing part 5, so that in this respect also, a very compact design, occupying little space, is obtained.

In principle, it is possible also to adopt a different type of control for the cylinders 12, 17, 19, 21. In particular, in the case of the control means 36 previously described also, the 2/2-way seat valves 37 and 38 may he so configured that they do not act as check valves but as shut-off valves, blocking in both directions when in closed condition.

Figure 4:
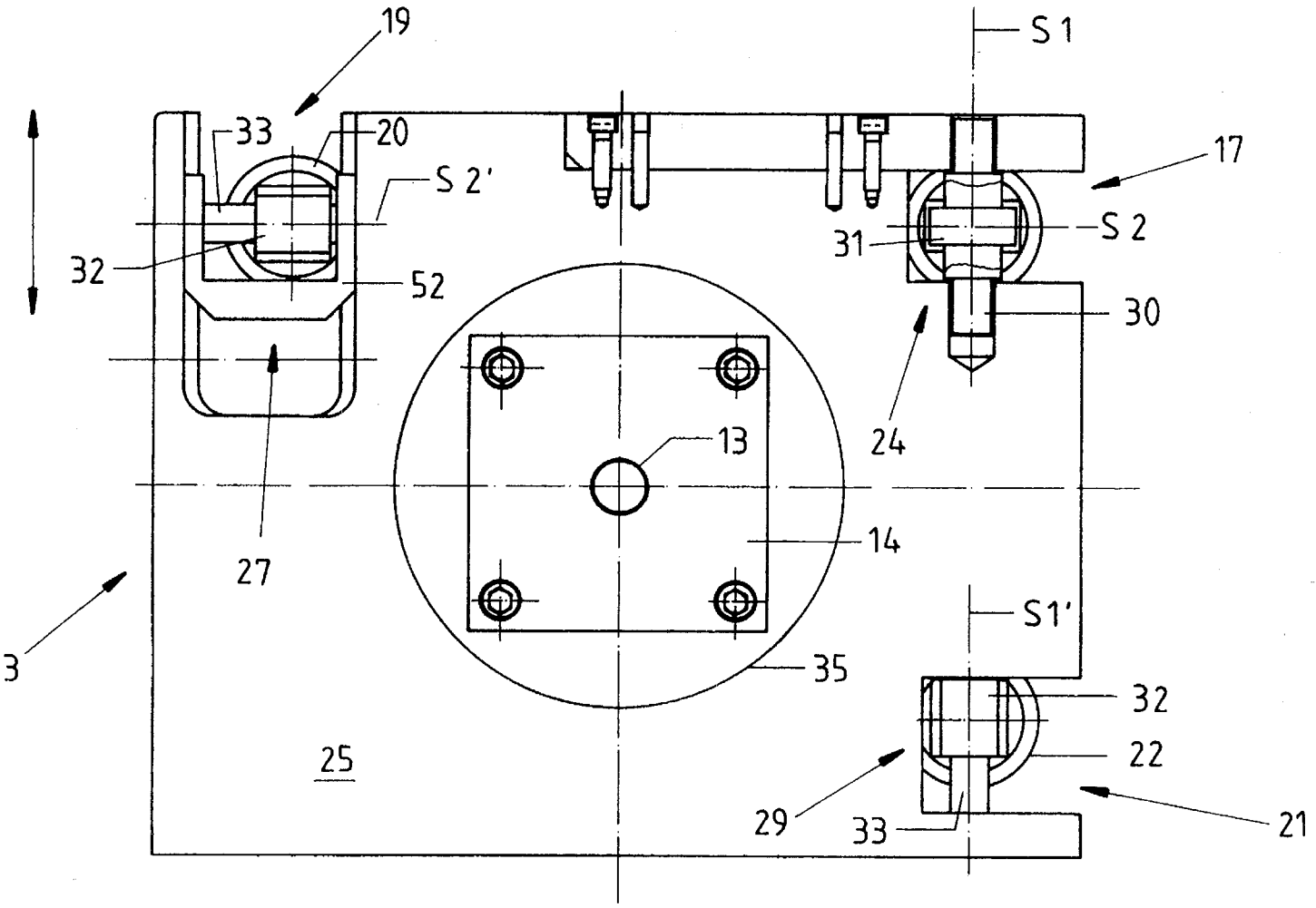
FIG. 4 shows a top view of the swing plate of the lift column of FIG. 2, in partial section.
Figure 5:
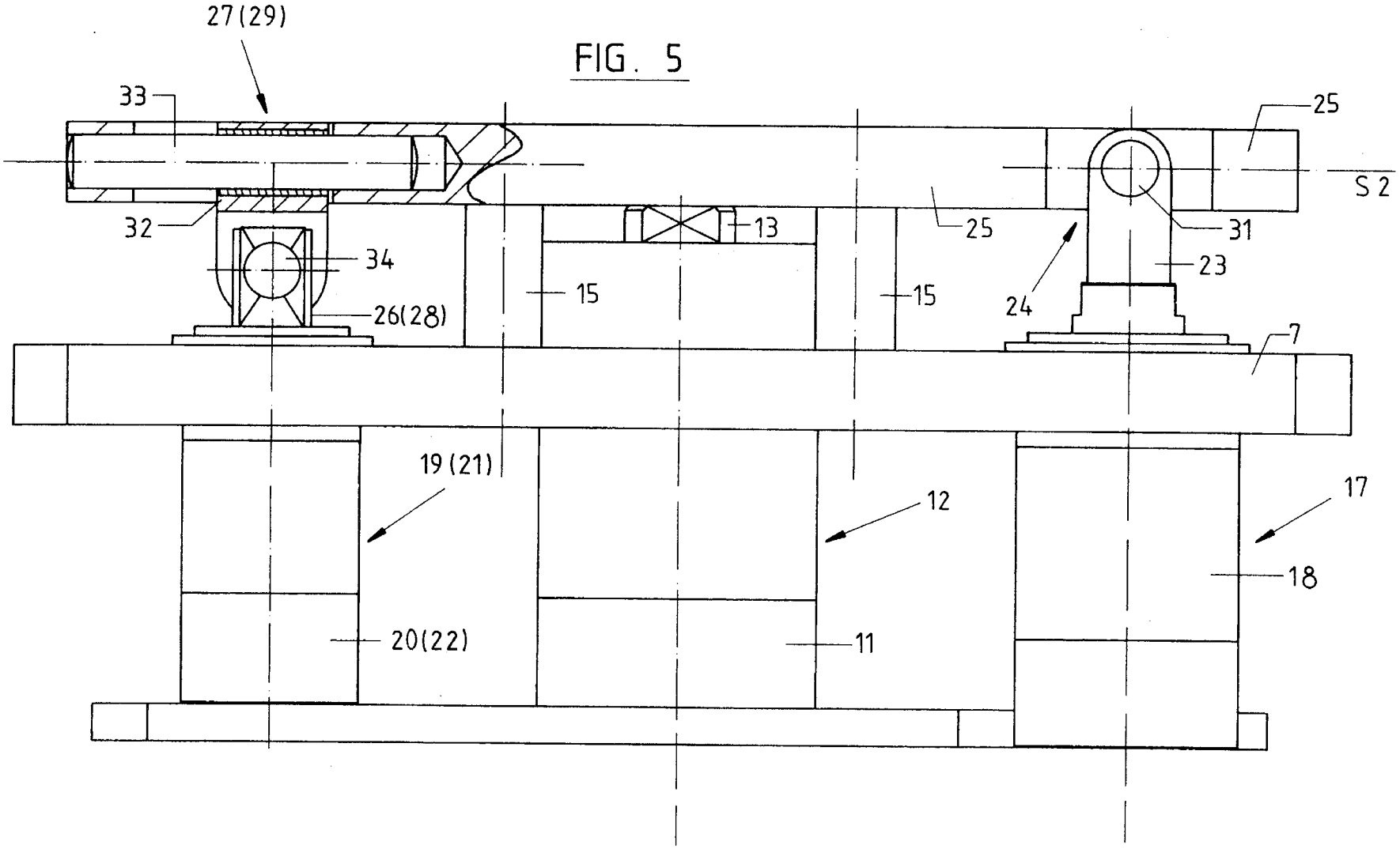
FIG. 5, in enlarged detail, shows the upper carrier platform and the swing plate provided above said platform, in a representation similar to FIG. 2.
Figure 6:
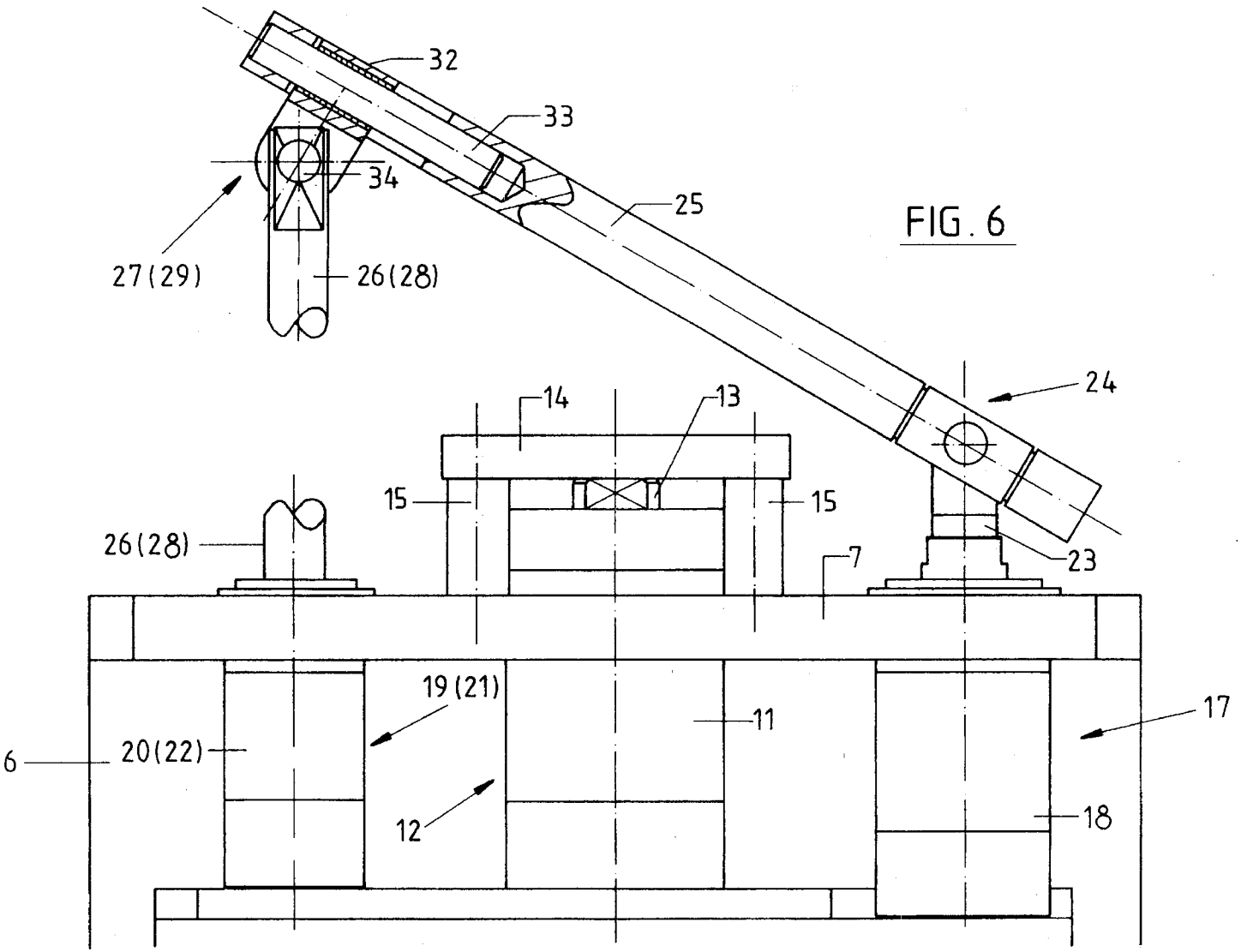
FIG. 6 shows a representation similar to FIG. 5, but with the swing plate swung.

FIG. 4 shows also that the articulations formed by the slide 32 and pins 33 is not provided fixed to the swing plate 25, but is displaceable in a horizontal axis extending perpendicular to the axis of swing S2' and hence parallel to the axes of swing S1 and S1' by a preassigned amount, in order thereby to avoid binding of the lift cylinders 17, 19 and 21 as well as excessive loads on the seals of these cylinders when the swing plate 25 is swung. For this motion perpendicular to the axis S2', the slide pin 33 is provided on a carriage 52 provided displaceable in this axis, extending perpendicular to the axis S2', on the swing plate 25.

Figure 8:
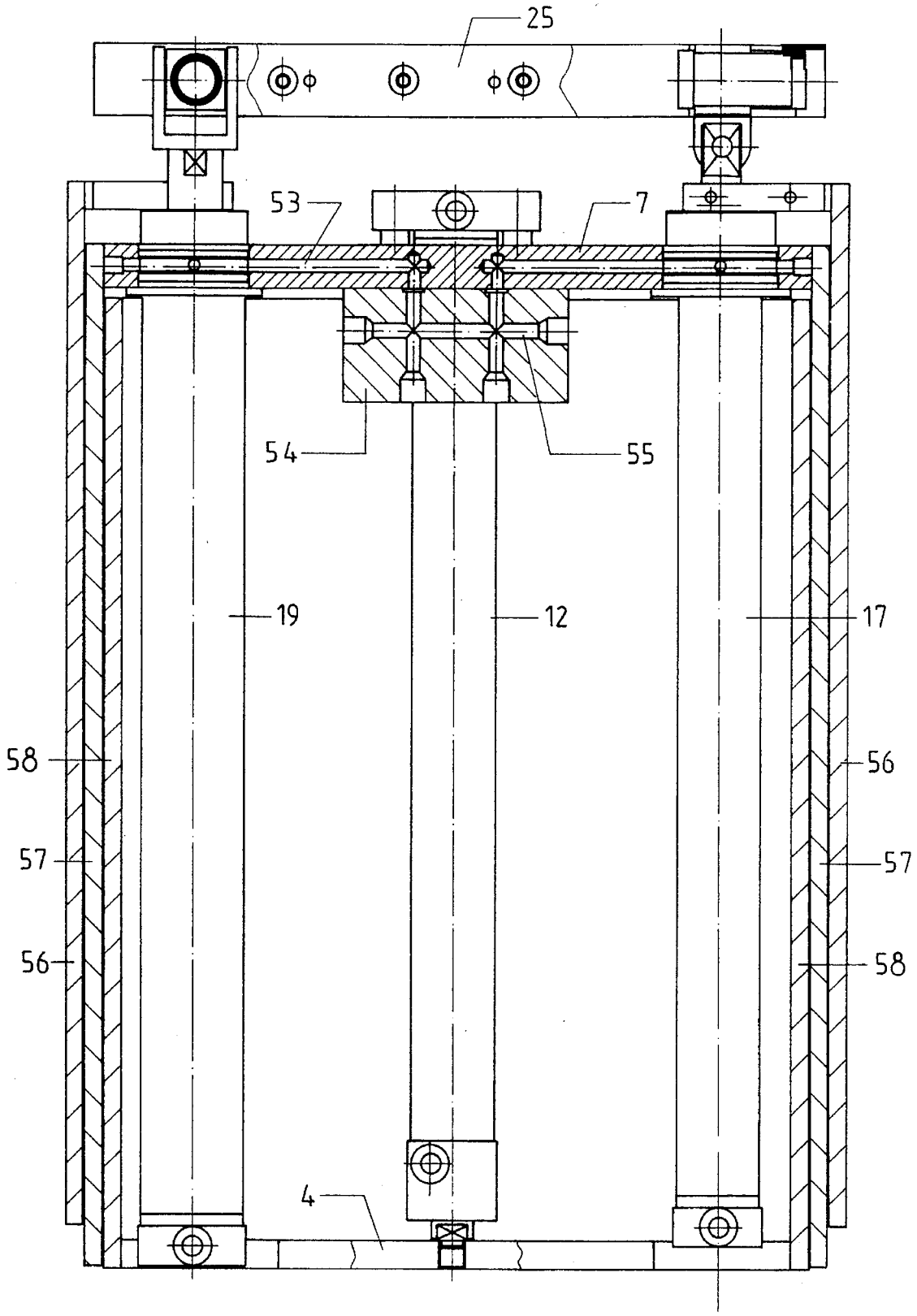
FIG. 8, in a representation similar to FIG. 2, shows another possible embodiment.
Figure 9:
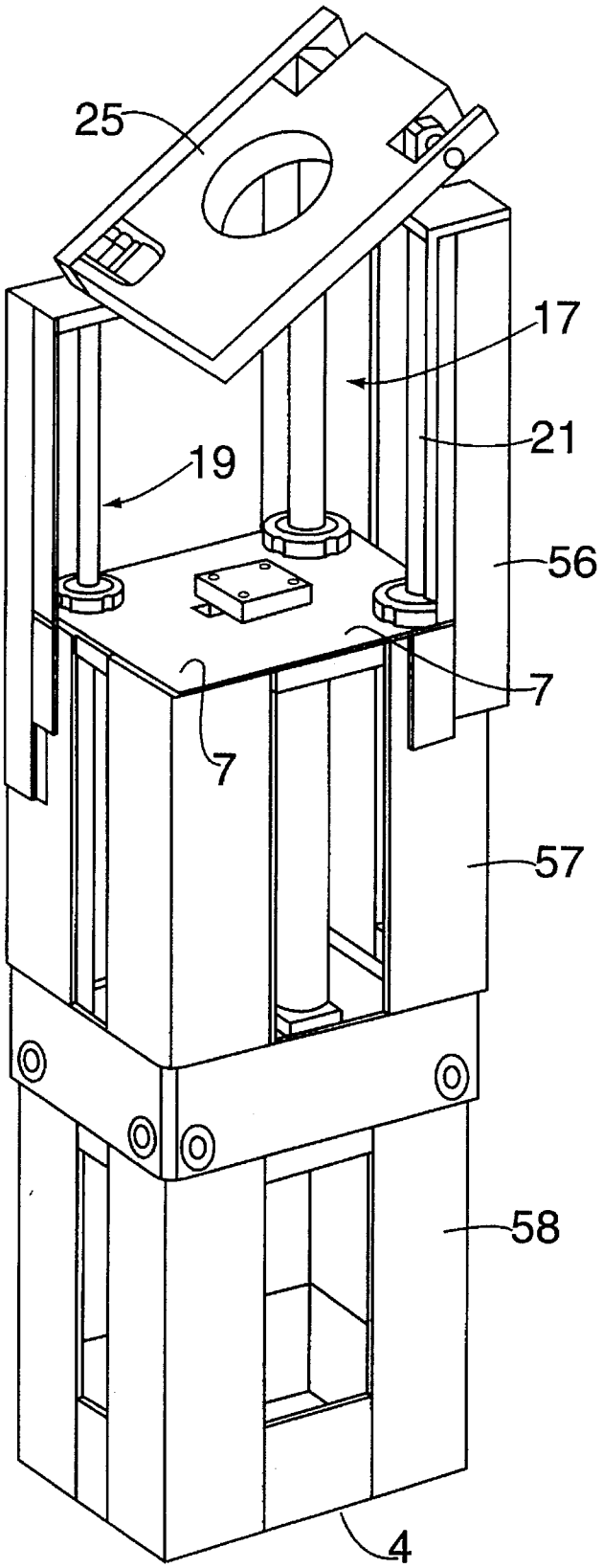
FIG. 9 shows the lift column of the figures in perspective view.

FIGS. 8 and 9 show an additional possible embodiment, differing from the embodiment of FIGS. 1 to 7 substantially only in that in the upper support plate 7, hydraulic passages 53 are provided, namely for the lift cylinders 17, 19 and 21. The valve block 54 of the control valve means 36 is screwed directly to the under side of the support plate 7, namely in such manner that the passages 55 provided in this valve block open directly into the passages 53, so that to this extent, no connecting hoses are required, and a very compact construction results.

For further stabilization, guide rails 56 in the form of angles are attached to the upper ends of the piston rods of the lift cylinders 17, 19 and 21, which rails are guided on guide rails 57 likewise in the form of angles on the upper support plate 7, the guide rails 57 being in turn guided on guide rails 58, likewise in angle form, on the bottom, stationary part of the lift column.

We claim:

1. Lift column for a raisable and lowerable carrier member, having a swing beam (25) bearing the carrier member and capable of being moved up and down by means of hydraulic cylinders (12, 17, 19, 21) for a controlled vertical travel and for being swung about two horizontal axes (S1, S2) perpendicular to each other for a tip or tilt motion, with at least one first lift cylinder having a housing (11) acting between a lower member (4) connected to a base (2) of the lift column and an upper member (7) connected to the swing beam (25) for a reciprocating motion of the upper member in an axis of vertical travel (VH), with at least one second and one third lift cylinder each acting on the swing beam (25) arranged over the said upper member (7) in areas spatially displaced from each other, characterized in that at least one fourth lift cylinder (21) is provided, likewise acting on the swing beam (25) spatially displaced from the second and third lift cylinders 19), and in that the second and third and fourth lift cylinders (17, 19, 21) connect the upper member (7) to the swing beam (25), for which uses they act between the upper member (7) and the swing beam (25), and each acts in one of areas of action, spatially displaced from each other, of the upper member (7), and in that cylinder housings (18, 20, 22) of the second, third and fourth lift cylinders (17, 19, 21) are each rigidly fixed to the upper member (7), and the piston rods (23, 26, 28) of the second, third and fourth lift cylinders (17, 19, 21) are each connected to the swing beam (25) by way of an articulation (24, 27, 29) forming the areas of action on which the lift cylinders (17, 19, 21) act on said swing beam (25).

2. Lift column according to claim 1, characterized by means (8, 10) for guiding the upper member (7) during vertical travel.

3. Lift column according to claim 1, characterized in that the lower member (4) and the upper member (7) are each formed on one of two housing parts (5, 6) telescoping one into the other and in that said housing parts (5, 6) comprise guidance means (8, 9).

4. Lift column according to claim 1, characterized in that said housing parts (5, 6) are each of tubular configuration and have axes and their axes are located coaxial with the axis of the vertical travel (VH).

5. Lift column according to claim 1, characterized in that the housings of all cylinders (12, 17, 19, 21) extend beyond a common side of the upper member (7).

6. Lift column according claim 1, characterized in that the housing (11) of the at least one first lift cylinder (12) is fixed to the lower member (4).

7. Lift column according to claim 6 wherein the first lift cylinder is fixed to the housing part (5) comprising said lower member and connected by its piston rod (13) to the upper member (7).

8. Lift column according to claim 1, characterized in that the lower member (4) is a plate.

9. Lift column according to claim 1, characterized in that the first lift cylinder (12) has an area of action on the upper member (7) located above the plane of the upper member (7).

10. Lift column according to claim 1, characterized by a control means (36) with which the lift cylinders (12, 17, 19, 21) are in each instance jointly controllable for the vertical travel and the third and fourth lift cylinders (19, 21) are each individually controllable for the tip and tilt motion.

11. Lift column according to claim 7 wherein the housings of all cylinders extend beyond the under side of the upper member.

12. Lift column according to claim 1 wherein the upper member (7) is a plate.

13. Lift column according to claim 1 wherein the swing beam (25) is a plate.

14. Lift column for a raisable and lowerable carrier member, having a swing beam (25) bearing the carrier member and capable of being moved up and down by means of hydraulic cylinders (12, 17, 19, 21) for a controlled vertical travel and for being swung about two horizontal axes (S1, S2) perpendicular to each other for a tip or tilt motion, with at least one first lift cylinder (12) having a housing (11) acting between a lower member (4) connected to a base (2) of the lift column and an upper member (7) connected to the swing beam (25) for a reciprocating motion of the upper member in an axis of vertical travel (VH), with at least one second and one third lift cylinder each acting on the swing beam (25) arranged over the said upper member (7) in areas spatially displaced from each other, characterized in that at least one fourth lift cylinder (21) is provided, likewise acting on the swing beam (25) spatially displaced from the second and third lift cylinders (17, 19), and in that the second, third and fourth lift cylinders (17, 19, 21) connect the upper member (7) to the swing beam (25), for which purposes they act between the upper member (7) and the swing beam (25), and each acts in one of areas of action, spatially displaced from each other, of the upper member (7), and in that the areas of action of the second, third and fourth lift cylinders (17, 19, 21) on the upper member (7) in each instance form the vertices of a triangle.

15. Lift column according to claim 14 wherein the triangle is a substantially right triangle.

16. Lift column according to claim 15 wherein the triangle is a right triangle.

17. Lift column according to claim 1 wherein the housings of all cylinders extend beyond the under side of the upper member.

18. Lift column for a raisable and lowerable carrier member, having a swing beam (25) bearing the carrier member and capable of being moved up and down by means of hydraulic cylinders (12, 17, 19, 21) for a controlled vertical travel and for being swung about two horizontal axes (S1, S2) perpendicular to each other for a tip or tilt motion, with at least one first lift cylinder (12) having a housing (11) acting between a lower member (4) connected to a base (2) of the lift column and an upper member (7) connected to the swing beam (25) for a reciprocating motion of the upper member in an axis of vertical travel (VH), with at least one second and one third lift cylinder each acting on the swing beam (25) arranged over the said upper member (7) in areas spatially displaced from each other, characterized in that at least one fourth lift cylinder (21) is provided, likewise acting on the swing beam (25) spatially displaced from the second and third lift cylinders (17, 19), and in that the second, third and fourth lift cylinders (17, 19, 21) connect the upper member (7) to the swing beam (25), for which purposes they act between the upper member (7) and the swing beam (25), and each acts in one of areas of action, spatially displaced from each other, of the upper member (7), and in that the area of action of the second lift cylinder (17) is formed by an articulation (24) exclusively permitting a swing about at least two axes extending perpendicular to each other.

19. Lift column according to claim 18, characterized in that the areas of action of the third and fourth lift cylinders (19, 21) are each formed by an articulation (27, 29) permitting a swing about at least two axes extending perpendicular to each other, and at the same time configured as a slide bearing permitting a displacement of the area of action in question in the direction of a change of the distance from the area of action of the second lift cylinder (17).

20. Lift column according to claim 18, wherein the housings of all cylinders extend beyond the under side of the upper member.

21. Lift column for a raisable and lowerable carrier member, having a swing beam (25) bearing the carrier member and capable of being moved up and down by means of hydraulic cylinders (12, 17, 19, 21) for a controlled vertical travel and for being swung about two horizontal axes (S1, S2) perpendicular to each other for a tip or tilt motion, with at least one first lift cylinder (12) having a housing (11) acting between a lower member (4) connected to a base (2) of the lift column and an upper member (7) connected to the swing beam (25) for a reciprocating motion of the upper member in an axis of vertical travel (VH) with at least one second and one third lift cylinder each acting on the swing beam (25) arranged over the said upper member (7) in areas spatially displaced from each other, characterized in that at least one fourth lift cylinder (21) is provided, likewise acting on the swing beam (25) spatially displaced from the second and third lift cylinders (17, 19), and in that the second, third and fourth lift cylinders (17, 19, 21) connect the upper member (7) to the swing beam (25), for which purposes they act between the upper member (7) and the swing beam (25), and each acts in one of areas of action, spatially displaced from each other, of the upper member (7), and in that said lift cylinders (12, 17, 19, 21) each are double-acting cylinders comprising two chambers separated by a piston, each chamber having a fitting, and in that the chambers of the lift cylinders (12, 17, 19, 21) are connected via their fittings in series between a first output (44) and a second output (45) of at least one control division (41).

22. Lift column according to claim 21, characterized in a second control division and that the third lift cylinder (19), connected to the second lift cylinder (17), is connected to a first output (44) of the second control division (42), and the third lift cylinder (19), connected to the fourth lift cylinder (21), is connected to a second output (45) of the second control division (42).

23. Lift column according to claim 21, characterized in a third control division and that a fourth lift cylinder, connected to the third lift cylinder (19), is connected to the first output (44) of the third control division (43), and the fourth lift cylinder (21), connected to the second output of the first control division, is connected to the third control division (43).

24. Lift column according to claim 21, characterized in that the control means (36) comprises two channels or lines (39, 40) connected to a switchable hydraulic system, in such manner that in a first state of the system, the one line (39) is the pressure line and the other line (40) is the non-pressure line, and in a second state of the system, the functions of these lines are interchanged, and in that control divisions (41–43) are each composed of two valves (37, 38), an outlet of each of which is connected to a channel (39) or to another channel (40) respectively, an inlet forming a first output (44) or a second output (45) of the control division.

25. Lift column according to claim 21 wherein there is a plurality of control divisions.

26. Lift column for a raisable and lowerable carrier member having a swing beam (25) bearing the carrier member and capable of being moved up and down by means of hydraulic cylinders (12, 17, 19, 21) for a controlled vertical travel and for being swung about two horizontal axes (S1, S2) perpendicular to each other for a tip or tilt motion, with a least one first lift cylinder (12) having a housing (11) acting between a lower member (4) connected to a base (2) of the lift column and an upper member (7) connected to the swing beam (25) for a reciprocating motion of the upper member in an axis of vertical travel (VH), with at least one second and one third lift cylinder each acting on the swing beam (25) arranged over the said upper member (7) in areas spatially displaced from each other, characterized in that at least one fourth lift cylinder (21) is provided, likewise acting on the swing beam (25) spatially displaced from the second and third lift cylinders (17, 19), and in that the second, third and fourth lift cylinders (17, 19, 21) connect the upper member (7) to the swing beam (25), for which purposes they act between the upper member (7) and the swing beam (25), and each acts in areas, spatially displaced from each other, of the upper member (7), and in that one axis of swing of articulations (27, 29) lies within the swing beam (25).

27. Lift column according to claim 26, characterized in that both axes of swing of an articulation (24) lie within the swing beam (25).

28. Lift column according to claim 26, characterized in that the vertical travel is greater than the structural height of the lift column.

29. Lift column according to claim 26, characterized in that the swing action is produced with the same elements (17, 19, 21) as employed for the vertical travel.

30. Lift column according to claim 26, characterized in that one axis of swing of the articulations (27, 29) lies within the swing beam (25).

31. Lift column for a raisable and lowerable carrier member, having a swing beam (25) bearing the carrier member and capable of being moved up and down by means of hydraulic cylinders (12, 17, 19, 21) for a controlled vertical travel and for being swung about two horizontal axes (S1, S2) perpendicular to each other for a tip or tilt motion, with at least one first lift cylinder (12) having a housing (11) acting between a lower member (4) connected to a base (2) of the lift column and an upper member (7) connected to the swing beam (25) for a reciprocating motion of the upper member in an axis of vertical travel (VH), with at least one second and one third lift cylinder each acting on the swing beam (25) arranged over the said upper member (7) in areas spatially displaced from each other, characterized in that at least one fourth lift cylinder (21) is provided, likewise acting on the swing beam (25) spatially displaced from the second and third lift cylinders (17, 19), and in that the second, third and fourth lift cylinders (17, 19, 21) connect the upper member (7) to the swing beam (25), for which purposes they act between the upper member (7) and the swing beam (25), and each acts in one of areas of action, spatially displaced from each other, of the upper member (7), and in that guide rails (56) are attached to upper ends of piston rods of the second, third and fourth lift cylinders (17, 19, 21), which guide rails are guided on guide rails (57) on said upper member (7).

* * * * *